US007374037B2

(12) United States Patent
Lipscomb et al.

(10) Patent No.: US 7,374,037 B2
(45) **Date of Patent: *May 20, 2008**

(54) TEXTURED CONTACT LENS PACKAGE

(75) Inventors: Lance Kyle Lipscomb, Cumming, GA (US); Michael Nelson Wilde, Kennesaw, GA (US)

(73) Assignee: Novartis AG, Basel (CH)

( * ) Notice: Subject to any disclaimer, the term of this patent is extended or adjusted under 35 U.S.C. 154(b) by 1244 days.

This patent is subject to a terminal disclaimer.

(21) Appl. No.: 09/942,347

(22) Filed: Aug. 29, 2001

(65) Prior Publication Data

US 2002/0046958 A1 Apr. 25, 2002

Related U.S. Application Data

(60) Provisional application No. 60/230,248, filed on Sep. 1, 2000.

(51) Int. Cl.
*A45C 11/04* (2006.01)

(52) U.S. Cl. ..... 206/5.1; 134/901

(58) Field of Classification Search ..... 206/5.1, 206/564, 205, 207, 210; 220/623, 624, 669; 428/35.7; 134/901; D3/264
See application file for complete search history.

(56) References Cited

U.S. PATENT DOCUMENTS

| | | | | |
|---|---|---|---|---|
| 4,377,329 A * | 3/1983 | Poler | 351/160 R |
| 4,392,569 A | 7/1983 | Shoup | 206/5.1 |
| 4,691,820 A | 9/1987 | Martinez | 206/205 |
| 5,054,610 A | 10/1991 | Ajello | 206/5.1 |
| 5,409,104 A | 4/1995 | Lovell | 206/5.1 |
| 5,467,868 A | 11/1995 | Abrams | 206/5.1 |
| 5,474,169 A | 12/1995 | Baumann | 206/5.1 |
| 5,609,246 A | 3/1997 | Borghorst | 206/5.1 |
| 6,050,398 A * | 4/2000 | Wilde et al. | 206/5.1 |

* cited by examiner

*Primary Examiner*—J. Gregory Pickett
(74) *Attorney, Agent, or Firm*—Sheng-Hsin Hu; Jian Zhou; Robert J. Gorman Jr.

(57) ABSTRACT

A container for storing a silicone hydrogel contact lens in a liquid, having a bowl portion with a radius such that the radius of the lens is from about 85 percent to about 100 percent of the inner surface radius. The bowl portion has an outer section which is defined by a radius larger than the inner surface radius. Furthermore, the bowl portion has a roughness sufficient to maintain capillary attraction of the lens to the bowl portion but preventing adhesion of any portion of the front surface of the lens to the bowl portion.

7 Claims, 2 Drawing Sheets

TEXTURED CONTACT LENS PACKAGE

This application claims the benefit of the filing date of U.S. 60/230,248, filed Sept. 1, 2000.

BACKGROUND OF THE INVENTION

The present invention relates to a contact lens storage container, and more particularly relates to a storage container for a soft hydrophilic contact lens.

Soft hydrophilic contact lenses are generally manufactured from hydrophilic polymer material. Depending on the composition of the polymer, the lenses may have a water content of from 20 percent to 90 percent or more. Such contact lenses must be preserved and stored in a liquid such as a sterile aqueous solution, usually an isotonic saline solution, to prevent them from drying out and to maintain them in a state ready for use.

Contact lenses have two curved surfaces with a circular edge in between. The surface that contacts the user's eyeball is called the base surface. The base surface cannot usually be defined m by a portion of a perfect sphere because the front of the human eyeball to which the base surface conforms is not perfectly spherical. Thus, the base surface cannot be defined by a single radius along its entire surface. However, a base curve equivalent radius is commonly used to approximate the radius of the base surface. The base curve equivalent radius is determined by a curvefitting calculation to derive an effective equivalent radius of the base surface from its complex shape.

Typical base curve equivalent radius sizes in use today include 8.2, 8.4, 8.6, 8.8, and 9.0 millimeters, with 8.4 and 8.8 millimeters being the most common. These sizes are arbitrarily chosen within the range of sizes that fits most people's eyeballs. Any size within the 8.2 to 9.0 millimeter range, and even smaller or larger sizes, is suitable for at least some people. The commonly-used sizes are chosen to reduce the number of different types of lenses that must be manufactured and inventoried to an amount small enough to safely and comfortably fit the vast majority of people that may be contact lens wearers.

The surface of the contact lens opposite the base surface is the front surface. The front surface typically has a more irregular surface than the base surface, as the variation in thickness of a contact lens that causes correction of vision is made relative to the base surface, which is sized to fit the user's eyeball. Typically, the front surface of a lens has three concentric areas, each having a different radius: a circular central optic zone, an annular outer edge zone, and an annular lenticular zone between the optic zone and the edge zone. Due to the high refractivity of the contact lens material, the variation in thickness required to correct vision is slight (on the order of about 80 microns). However, in view of the shapes of the base surface and the front surface, contact lenses are typically identified according to base curve equivalent radius and optical properties, rather than according to their front surface shape.

Numerous types of containers for storing contact lenses are known, such as those described in U.S. Pat. Nos. 4,392,569; 4,691,820; 5,054,610; 5,409,104; 5,467,868; 5,474,169; and 5,609,246. Known containers all include some sort of a chamber for holding the contact lens and storage liquid, and some sort of a cover for keeping the lens and liquid in the chamber.

U.S. Pat. No. 5,609,246 discloses a contact lens storage container having a chamber formed in two portions. The main portion of the chamber is dish-shaped or bowl-shaped.

Also, the main portion is sized so that it can accommodate contact lenses of various sizes, with a diameter of approximately 20 mm at the chamber opening and a depth of approximately 6 mm measured perpendicular to the plane of the opening.

U.S. Pat. No. 5,474,169 discloses a contact lens storage container having a cavity for receiving a lens and liquid, the lens base surface being placed on a post extending upward from a bottom surface of the cavity. The cavity is substantially larger than the lens, and is designed so that a thumb and forefinger can be placed into the cavity on opposite sides of the post for removing the lens from the container.

U.S. Pat. No. 5,467,868 discloses an ophthalmic lens package having a bowl with a radius of curvature greater than that of the front surface of a contact lens such that the lens settles to the bottom center of the bowl when placed in the package. The preferred bowl radius of curvature is stated to be 9.5 mm, with 9.5 to 12.0 mm being a preferred range. The bowl is intentionally sized so that the contact lens only touches the bowl at one point, and no line or surface contact between the lens or bowl occurs, as clearly shown in FIG. 3 of that patent. Thus, the lens is free to move about the bowl as the package is moved. If the package is held upright, the lens settles at the center (bottom) of the bowl, but does not adhere to the bowl.

Recently, new types of silicone based hydrogel contact lenses have been developed that can have memory characteristics. If this type of contact lens is held in a position different from its normal bowl-shaped position, the shape of the lens may be changed by a small amount. For example, folding of the lens in half or inverting of the lens may change its shape. While the storage containers disclosed in the above patents work well for use with conventional contact lenses, it is possible that these and other storage containers might allow contact lenses to change shape while in storage or transit to an ultimate user.

During manufacture of contact lenses, lens inspection is often performed by visually detecting and observing each lens after placement in the storage liquid in the container. Often, the container is made at least partially translucent so that the lens may be inspected through the chamber wall after the cover is placed over the chamber. Inspecting a contact lens in the chamber, whether one of the hydrogel lenses described above or a conventional lens, may be difficult or impossible if the lens is curled or inverted.

Typical prior art contact lens containers have chambers substantially larger than the lenses. Thus, locating a clear contact lens in a clear storage solution within the chamber may be difficult during manufacture, inspection, or use by the user, especially if the lens has moved away from the bottom of the chamber. For example, inspection of a contact lens may be impossible if the lens is not at the chamber bottom. Also, a user may have to feel around the chamber with a finger to locate the contact lens, which could possibly lead to inadvertent loss or tearing of the lens in some situations.

In addition, it has been found that the silicone hydrogel lens will stick to the bowl of the container when the radius of the container closely approximates the radius of the lens. There is therefor a need to find a way to modify the bowl of the container to prevent adhesion of the silicone hydrogel lens to the bowl.

OBJECTS AND SUMMARY OF THE INVENTION

It is a principle object of the present invention to provide an improved contact lens storage container that can be readily adapted to various applications.

Another object of the present invention is to provide a contact lens storage container that is simple and inexpensive to manufacture, and that is reliable in use.

Still another object of the present invention is to provide a contact lens storage container that prevents curling or inversion of contact lenses once placed within the container.

Yet another object of the present invention is to provide a contact lens storage container that does not allow a silicone hydrogel contact lens to adhere to the bowl of the container.

To achieve these objects and in accordance with the purposes of the invention, as embodied and broadly described herein, a container is provided for storing a contact lens in a liquid, the contact lens having a base surface defining a base curve equivalent radius and a front surface. The container includes a base portion and a bowl portion formed integral with the base portion for containing the liquid and the contact lens. The bowl portion includes a lens seating section having an inner surface defined by a radius sized from slightly larger than to equal to the base curve equivalent radius. The front surface of the contact lens does not adhere to the bowl because the bowl is roughened to a Charmille no. of 16 to 30, preferably 18 to 26. It is important that no part of the front surface of the lens adheres to the package.

The bowl may be roughened by a variety of techniques, but the most convenient method is to roughen the surface of the mold used to produce the package. Electron discharge machining (EDM) is an electron discharge method which etches a uniform pattern of roughness on the surface of the mold through the application of electricity. The surface of the mold may also be sandblasted using a grit of appropriate size. The roughness of the mould should result in a textured surface on the bowl Charmille no. of 16 to 30, preferably 18 to 26.

As described herein it is believed that the contact lens is held by capillary attraction. The degree of roughness should be predetermined to sufficiently maintain the capillary attraction but prevent adhesion of a silicone based hydrogel contact lens to the bowl of the package.

Preferably, the base curve equivalent radius is from about 8.2 to about 9.0 mm, and more preferably from about 8.4 mm to about 8.8 mm. Also, preferably the inner surface radius is about 9.0 mm and the base curve equivalent radius is from about 8.4 mm to about 8.8 mm. Preferably, the base curve equivalent radius is at least about 90 percent of the inner surface radius.

The bowl portion preferably includes an outer section between the lens seating section and the base portion, wherein the outer section extends outward from the inner surface, and wherein the outer section includes an outer surface defined by a radius larger than the inner surface radius. Preferably, the inner surface radius is about 9.0 mm and the outer surface radius is about 10.0 mm. The bowl portion preferably has a thickness in a direction parallel to a given inner surface radius of about 1.0 mm.

The base portion preferably defines an upper surface that is substantially planar and that includes a sealing area extending around the bowl portion. The base portion may include grips extending at an angle to the upper surface. The container may further include a cover secured to the base portion for confining the contact lens and the liquid in the bowl portion. The cover may include a sealing layer secured to the sealing area of the base portion, an upper layer, and a foil layer therebetween.

In accordance with another aspect of the invention, a container is provided for storing a contact lens in a liquid, the contact lens having a base surface defining a base curve equivalent radius and a front surface. The container includes a base portion and a bowl portion formed integral with the base portion for containing the liquid and the contact lens. The bowl portion includes a lens seating section having an inner surface defined by a radius, the base curve equivalent radius being from about 85 percent to about 100 percent, preferably from about 90 percent to about 100 percent, more preferably from about 93 percent to about 100 percent, most preferably from about 95 percent to about 100 percent, of the inner surface radius.

In accordance with another aspect of the invention, a container is provided for storing a contact lens in a liquid, the container including a base portion and a bowl portion formed integral with the base portion for containing the liquid and the contact lens. The bowl portion includes a lens seating section having an inner surface defined by a radius of about 9.0 mm.

Additional objects and advantages of the invention will be set forth in part in the following description, or may be obvious from the description, or may be learned through the practice of the invention.

BRIEF DESCRIPTION OF THE DRAWINGS

The present invention will be fully understood from the following detailed description, taken in conjunction with the accompanying drawings, wherein like reference numerals refer to like parts, and in which.

DETAILED DESCRIPTION OF THE PREFERRED EMBODIMENT

Figure 1:
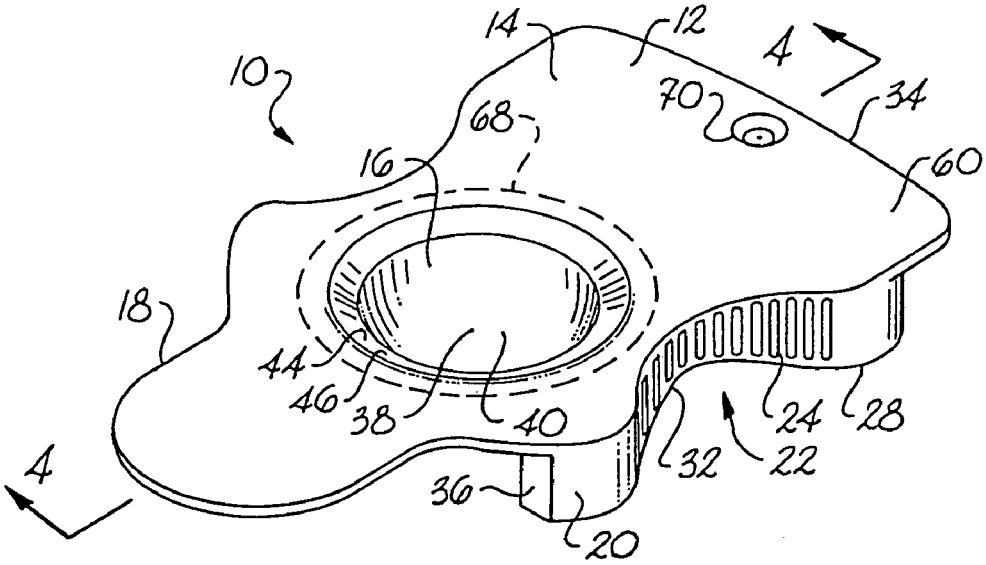
FIG. 1 is a top perspective view of a preferred embodiment of a contact lens storage container according to the present invention.
Figure 2:
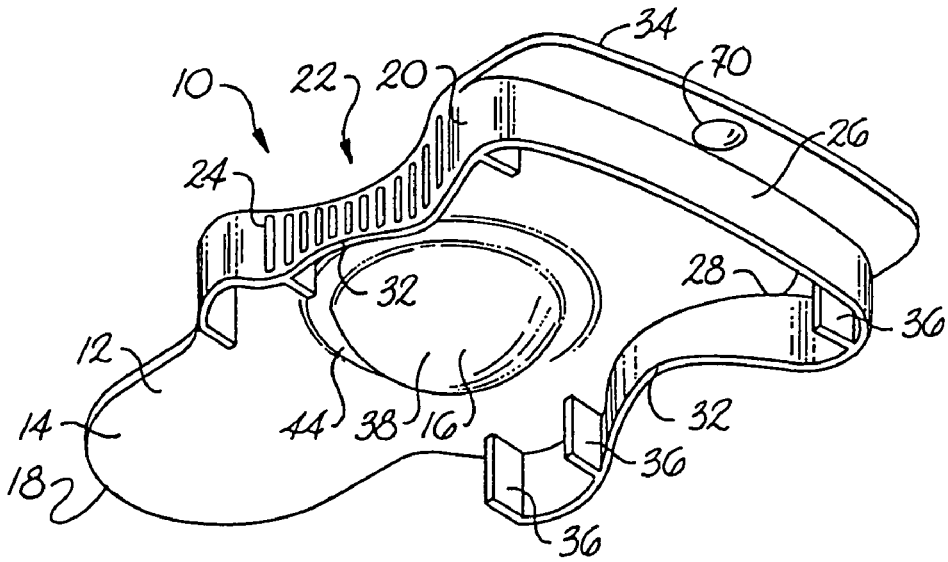
FIG. 2 is a bottom perspective view of the contact lens storage container of FIG. 1.

Reference will now be made in detail to the presently preferred embodiment of the invention, one or more examples of which are illustrated in the drawings. Each example is provided by way of explanation of the invention and not meant as a limitation of the invention. For example, features illustrated or described as part of one embodiment or figure can be used on another embodiment or figure to yield yet another embodiment. It is intended that the present invention include such modifications and variations.

As embodied in FIGS. 1-5, a contact lens storage container is provided for storing a contact lens 1 in a liquid. The preferred embodiment of container 10 includes a receptacle 12 having a base portion 14 and a bowl portion 16. Base portion 14 is substantially planar and may have an irregular edge 18. Bowl portion 16 preferably is defined by two radii, as will be described below. Wall 20 extends substantially perpendicular to base portion 14. Wall 20 includes grip portions 22 formed on inwardly curving portions of edge 18. Grip portions 22 may have surface irregularities 24, such as the ridges shown in the Figures, for preventing slippage out of a user's hand while handling receptacle 12. Other types of irregularities 24, such as grooves or a surface texture, may also be employed.

Wall 20 also includes a rear portion 26, substantially forming a U-shape with grip portions 22, thereby surrounding bowl portion 16 on three sides. Wall 20 extends from base portion 14 at least as far as bowl portion 16 extends from base portion 14 to allow for stacking of multiple containers 10, for example for shipment or storage. The bottom edge 28 of wall 20 is shaped to provide a flat surface 30 parallel to base portion 14. Indentations 32 are preferably disposed in edge 28 to improve gripping and to reduce the amount of material required for receptacle 12. Preferably, rear portion 26 of wall 20 is spaced slightly from the rear 34 of edge 18 of base portion 14 to also improve gripping. Wall 20 preferably includes stiffening portions 36 extending from and integral with grip portions 22 or rear portion 26.

In accordance with the invention section 38 having an inner surface includes a lens seating section 38 having a roughened inner surface 40 defined by an inner surface radius 42. Bowl portion 16 also includes an outer section 44 having an outer surface 46 defined by a radius 48. The roughened inner surface of bowl portion 16 may extend to outer section 44 and outer surface 46.

Inner surface 40 and outer surface 46 may be roughened by a variety of techniques, but the most convenient method is to roughen the surface of the mold used to produce the package. Electron discharge machining (EDM) is an electron discharge method which etches a uniform pattern of roughness on the surface of the mold through the application of electricity. The surface of the mold may also be sandblasted using a grit of appropriate size. The roughness of the mould should result in a textured surface on the bowl Charmille no. of 16 to 30, preferably 18 to 26.

As described herein it is believed that the contact lens is held by capillary attraction. The degree of roughness should be predetermined to sufficiently maintain the capillary attraction but prevent adhesion of a silicone based hydrogel contact lens to the bowl of the package.

Lens 1 includes a lens front surface 50 and a lens base surface 52. Neither of the two lens surfaces 50 or 52 are necessarily perfectly spherical, for the reasons discussed above. However, lens base surface 52 can be approximated by lens base curve equivalent radius 54.

Figure 5:
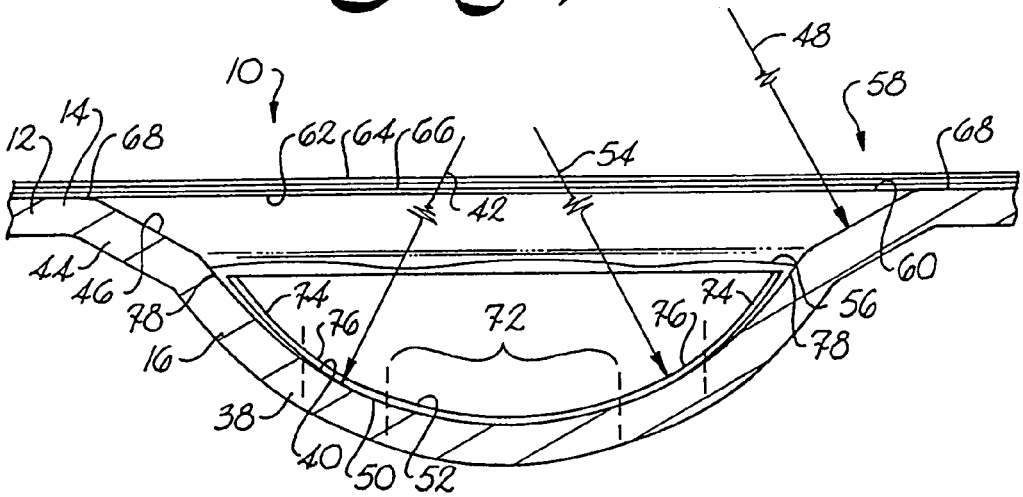
FIG. 5 is an enlarged sectional view of the bowl portion of the contact lens storage container section shown in FIG. 4, further showing the placement of the contact lens within the bowl portion and the cover.

In accordance with the invention and as shown in FIG. 5, lens seating section inner surface radius 42 is sized from slightly larger than to equal to base curve equivalent radius 54. Preferably, base curve equivalent radius 54 is from about ninety percent to about one hundred percent of the lens seating section inner surface radius 42. For example, typical base curve equivalent radius sizes are from about 8.2 to 9.0 mm. More typical base curve equivalent radius sizes are from about 8.4 mm to about 8.8 mm, with either 8.4, 8.6, or 8.8 mm being the most commonly used sizes. Thus, inner surface radius 42 should be about 9.0 mm to accommodate the lenses of the typical sizes manufactured.

A 9.0 millimeter radius on the lens seating section inner surface 40 ensures that the base curve equivalent radius 54 of lens 1 will be slightly smaller than or about the same size as the lens seating section inner surface radius 42 of 8.4 mm to 8.8 mm lenses. Making the lens seating section 38 of bowl portion 16 have dimensions approximating the base curve equivalent radius 54 allows at least a portion of front surface 50 of lens 1 to removably adhere to inner surface 40 of lens seating section 38 as lens 1 sits in liquid 56 in bowl portion 16. Although not wished to be bound by any theory, it is believed that the adhesion is caused by capillary attraction. The relative sizing of lens 1 and bowl portion 16 provides the benefits that lens 1 is more likely to be properly located, and is more likely to not be folded or inverted. Also, such sizing prevents any rippling of the lens around its edge 78 that would occur if the bowl portion radius 42 were smaller than the lens radius 54. Reducing the possibility of such mislocation, inversion, folding, or rippling substantially reduces the occurrence of lens deformation, loss, or damage.

The inventors have surprisingly found that roughening bowl portion 16 will prevent silicone hydrogel lens 1 from sticking to the bowl portion 16

As shown in FIG. 5, it is preferable that at least a substantial portion of optic zone 72 of lens 1 contacts and adheres to lens seating section 38. More preferably, optics is zone 72, lenticular zone 76, and substantially all of edge zone 74 adhere, with only the outer rim 78 and a small portion of edge zone 74 being spaced from lens seating section 38. It is possible that a 9.0 mm radius for surface 40 will be too large for some smaller lenses (e.g., some lenses with 8.4 mm base curve equivalent radii) or lenses with a high Rx value (+6.00 to +10.00). For such lenses, it is within the scope of the invention to provide a radius of smaller than 9.0 mm (e.g., 8.6 mm) for surface 40 so that the lens radius is slightly smaller than or about the same as the surface radius. Thus, the 9.0 mm radius embodiment is merely one commercially preferred embodiment of the present invention.

In a (14.0/8.8/−1.00) lens, lens front surface 50 has a surface area of approximately 205 $mm^2$, and the portions of surface 50 including optic zone 72, lenticular zone 76, and edge zone 74 have respective areas of 54 $mm^2$, 67 $mm^2$ and 84 $mm^2$. Thus, the area of contact between lens front surface 50 and lens seating section 38 is preferably at least about 54 $mm^2$, and at least about 25 percent of the entire area of the lens front surface 50 contacts to lens seating section 38. More preferably, the area of contact is between about 25 and 100 percent, particularly between about 40 and 100 percent, more particularly between about 50 and 100 percent, of the entire area of the lens front surface 50 contacts. Applicants have estimated the actual area of contact of a 14.0/8.8/−1.00 lens by determining how much of the lens would be within 0.001 inch of a 9.0 mm bowl (assuming the lens were a rigid body). Applicants determined that about 76 $mm^2$, or 37% of the surface 50, would be within 0.001 inch and thus contact the bowl. For such a lens, Applicants therefore estimate that all of optic zone 72 and some of the lenticular zone 76 would contact the bowl. It should be understood that a greater or lesser amount of contact are both within the scope of the invention, including an amount of contact less than the whole of the optic zone 72.

In order to allow for efficient commercial production of containers suitable for various lens sizes, it is preferable to size lens seating section 38 so that rim 78 does not contact lens seating section 38. However, if desired, individually matched receptacles could be made that were perfectly sized so that edge 78 laid on lens seating section 38 but did not ripple. Such a receptacle would only be suitable for lenses of a radius matching that lens seating section 38 or smaller. Thus, an 8.8 millimeter radius lens seating section 38 should accept and seat all 8.4 and 8.8 millimeter base curve equivalent lenses. However, using a 9.0 millimeter size ensures that, in view of manufacturing tolerances and differences in lens shape, the most commonly used lenses (from 8.4 to 8.8 mm) will maintain capillary attraction to lens seating section 38 across most of the lens front surface 50.

Bowl portion outer surface radius 48 is larger than bowl portion lens seating section inner surface radius 42. Preferably, outer surface radius 48 is about 10.0 mm. The sizing of outer section 44 of bowl portion 16 allows a user to more readily insert a finger into lens seating section 38 to thereby remove lens 1 from container 10. The larger sizing of radius 48 of outer surface 46 of bowl portion outer section 44, as compared to radius 42 of inner surface 40 of lens seating section 38, also beneficially prevents spillage of liquid during the filling process and afterward.

Figure 3:
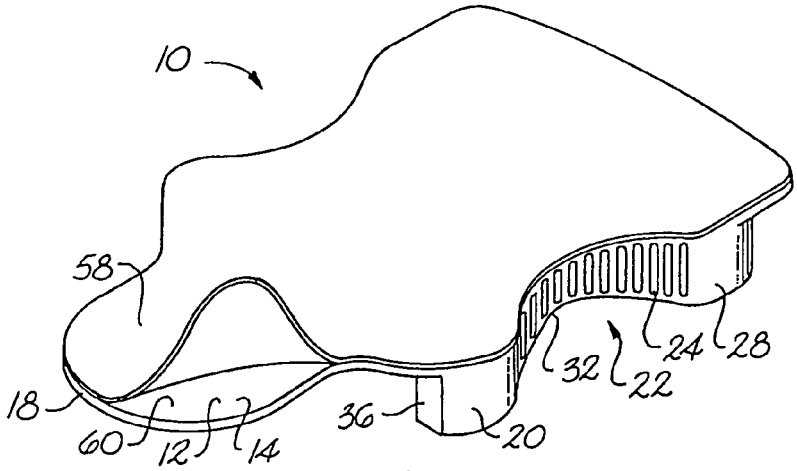
FIG. 3 is a top perspective view of the contact lens storage container of FIG. 1 with a cover attached to the upper surface of the base portion of the container.
Figure 4:
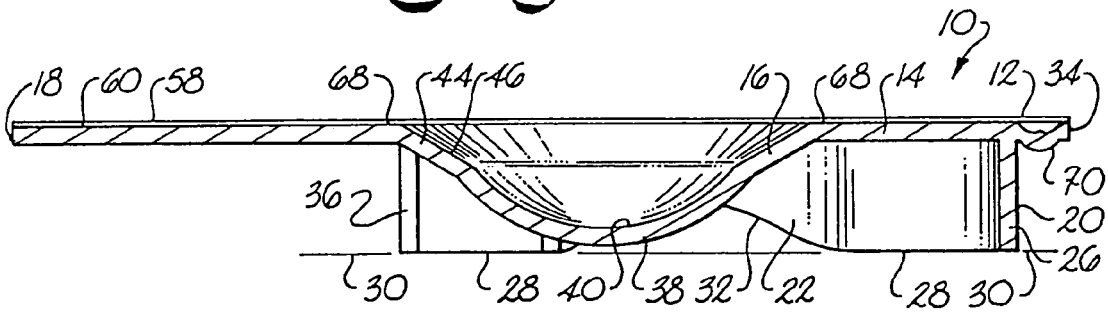
FIG. 4 is a sectional view of the contact lens storage container of FIG. 1 taken along line 4-4 in FIG. 1.

As shown in FIG. 3, a cover 58 may be disposed atop upper surface 60 of receptacle 12. Upper surface 60 extends along all of base portion 14, and is in contact with cover 58 which is shaped to cover substantially all of upper surface 60. Cover 60 seals lens 1 and liquid 56 within bowl portion 16.

As shown in FIG. 5, cover 60 is made of a sealing layer 62, an upper layer 64, and a foil layer 66 between the sealing and upper layers. Sealing layer 62 is made of, e.g., polyethylene and is heat sealed to a sealing area 68 of upper surface 60 of receptacle 12. Foil layer 66 is made of a metal foil and maintains liquid 56 within bowl portion 16. Upper layer 64 is made of, e.g., polyester and may include written information identifying the lens, maker, prescription, etc. Other layers may be used, and any combination of the above or other layers may be used within the scope of the present invention.

Sealing area 68 (see FIG. 1) surrounds outer section 44 of bowl portion 16 and includes a portion of upper surface 60 of receptacle 12. Preferably, receptacle 12 is formed by injection molding. To improve sealing between cover 58 and receptacle 12, discontinuities on upper surface 60, whether caused by manufacturing or inherent in design, should be eliminated or moved as far as possible from sealing area 58. For example, gate 70, which is formed by the injection molding process, is located distant from sealing area 68 to preclude any interference with sealing of cover 58 on receptacle 12.

Preferably, bowl portion 16 has a thickness in a direction parallel to a given inner surface radius 42 of approximately 0.9 mm or more. Also, the ratio of volume of bowl portion to surface area of the outermost circumference of bowl portion outer section 36 should be preferably 1.21 $mm^3/mm^2$. More preferably, the thickness is at least 1.0 mm and the ratio is 1.35 $mm^3/mm^2$ These thicknesses and ratios ensure an acceptable shelf life of a lens 1 stored in container 10 if properly sealed in a suitable liquid 56 by a cover 58.

Preferably, receptacle 12 is made of a polymeric material such as polyethylene or polypropylene, and is preferably formed by injection molding.

It will be apparent to those skilled in the art that 15 various modifications and variations can be made in the present invention without departing from the scope and spirit of the invention. It is intended that the present invention include such modifications and variations as come within the scope of the appended claims and their 20 equivalents.

The invention claimed is:

1. A container for storing a silicone hydrogel contact lens in a liquid, the silicone hydrogel contact lens having a base surface defining a base curve equivalent radius and a front surface, the container comprising:

a base portion; and a bowl portion formed integral with the base portion for containing the liquid and the contact lens, the bowl portion including a lens seating section having an inner surface defined by a radius, the base curve equivalent radius being from about 85 percent to about 100 percent of the inner surface radius, and an outer section between said lens seating section and said base portion, wherein said outer section has an outer surface which is defined by a radius larger than the inner surface radius, and wherein said bowl portion has a roughness sufficient to maintain capillary attraction of the lens to said bowl portion but preventing adhesion of any portion of the front surface of the silicone based hydrogel contact lens to the bowl portion.

2. The container of claim 1, wherein the bowl portion is roughened to a Charmille No. of 16 to 30.

3. The container of claim 1, wherein the bowl, portion is roughened to a Charmille No. of 18 to 26.

4. The container of claim 1, wherein the inner surface radius is about 9 mm and the outer surface radius is about 10 mm.

5. A container for storing a contact lens in a liquid, the container comprising:

a base portion; and a bowl portion formed integral with the base portion for containing the liquid and the contact lens, the bowl portion including a lens seating section having an inner surface defined by a radius of about 9.0 mm, and an outer section between said lens seating section and said base portion, wherein said bowl portion is roughened to a Charmille no. of 16 to 30, wherein said outer section has an outer surface which is defined by a radius larger than the inner surface radius.

6. The container of claim 5, further including a cover for confining the contact lens and the liquid in the bowl portion.

7. The container of claim 5, wherein the said bowl portion is roughened to a Charmille No. of 18 to 26.

* * * * *